United States Patent [19]

Greenwood

[11] Patent Number: 4,896,878

[45] Date of Patent: Jan. 30, 1990

[54] RECREATIONAL DEVICE

[76] Inventor: Marvin H. Greenwood, 3444 Wickersham, Houston, Tex. 77027

[21] Appl. No.: 255,344

[22] Filed: Oct. 11, 1988

[51] Int. Cl.[4] ..... A63G 9/00

[52] U.S. Cl. ..... 272/85; 272/40; 272/41; 272/50; 297/274

[58] Field of Search ..... 272/31 R, 40, 41, 33 R, 272/34, 85, 50; 297/273, 274, 275, 276, 277, 278, 279

[56] References Cited

U.S. PATENT DOCUMENTS

| | | | |
|---|---|---|---|
| 982,993 | 1/1911 | Rayner | 272/34 |
| 1,670,882 | 5/1928 | Eckberg . | |
| 1,771,965 | 7/1930 | Mills | 272/85 X |
| 2,407,843 | 9/1946 | McDonald | 272/40 |
| 2,467,338 | 4/1949 | Sellards . | |
| 2,499,164 | 2/1950 | Richardson | 297/274 |
| 2,525,458 | 10/1950 | Peterson | 272/41 X |
| 2,841,395 | 7/1958 | Walker . | |
| 3,088,733 | 5/1963 | Ayres . | |
| 3,127,169 | 3/1964 | Guihan . | |
| 3,186,711 | 6/1965 | Morrow . | |
| 3,439,914 | 4/1969 | Willard . | |
| 3,462,140 | 8/1969 | Halaj . | |
| 3,858,871 | 1/1975 | Bourne . | |
| 4,036,489 | 7/1977 | Potyondy . | |
| 4,046,375 | 9/1977 | Lelong . | |
| 4,519,602 | 5/1985 | Sutherland . | |
| 4,620,700 | 11/1986 | Snarr . | |

FOREIGN PATENT DOCUMENTS

| | | | |
|---|---|---|---|
| 756754 | 12/1933 | France | 272/40 |

*Primary Examiner*—Richard E. Chilcot, Jr.
*Attorney, Agent, or Firm*—Vinson & Elkins

[57] ABSTRACT

The occupant propelled recreational or amusement device and playground toy includes an elongated central support having a bearing device or rotatable hub affixed at its upper end. The hub defines a rotational axis which is inclined with respect both to a vertical reference line and to a horizontal reference plane. A radially outwardly extending cross member is attached to a rotating part of the hub and has depending from its distal end portion at least one elongated flexible supporting member which suspends a seat for omnidirectional movement. The seat is capable of being moved upwardly and downwardly in an arcuate fashion, is capable of being moved forwardly and backwardly in an arcuate as well as in a circular fashion about a stationary central support, and is capable of moving radially outwardly in arcuate fashion due, for example, to centrifugal force.

26 Claims, 4 Drawing Sheets

RECREATIONAL DEVICE

FIELD OF THE INVENTION

This invention pertains to a recreational or amusement device and playground toy, primarily intended for use by children. Specifically, the device is an occupant propelled swing which is suspended from a cross member by flexible supporting members and which rotates about an axis which is inclined with respect to a vertical reference line. The device may be operated by a single rider positioned within a seat suspended by the flexible supporting members which seat and supporting members revolve about the inclined axis and travel in an arcuate fashion in an oblique plane relative to a horizontal plane of reference. The device is designed to permit the occupant of the seat to manipulate the seat in a manner which includes rotation of the support member, the seat and its occupant about the inclined axis. This manipulation is accomplished by the operator repeatedly shifting his weight relative to the axis of rotation of the device at the proper time.

BACKGROUND OF THE INVENTION

Amusement devices such as the conventional swing and such as the roundabout, carousel or merry-go-round have long provided entertainment for both children and adults by transporting them in a back and forth and in a revolving circular pattern, respectively. Amusement devices of this type have been designed to be used freely by one or a few occupants, and are found, for example, in school yards, public parks, and home play yards. In fact, many of the smaller units have been designed to be propelled by the riders.

With certain merry-go-rounds, for example, the riders may push or pull the revolving portion of the merry-go-round, until considerable speed is attained, then leap on the ride until the kinetic energy is dissipated. Other merry-go-rounds have been designed wherein the structure for supporting the revolving load has its axis of rotation offset from the vertical so that the plane of rotation is offset from the horizontal. Such user operated merry-go-rounds are sustained in motion to a large extent by the occupants, while seated upon the device, supplying the necessary energy to move the merry-go-round in an orbital path. Examples of these inclined, merry-go-round style amusement devices are disclosed by Eckberg in U.S. Pat. No. 1,670,882; by Walker in U.S. Pat. No. 2,841,395; by Willard in U.S. Pat. No. 3,439,914; and by Halaj in U.S. Pat. No. 3,462,140.

Another type of occupant propelled amusement device is the swing. Simple swings have been used for uncounted centuries and are particularly beloved by children. The best known style of swing comprises a seat suspended by at least one flexible supporting member depending from a stationary cross member. In operation, the user simply supplies energy to move the swing forwardly and backwardly by thrusting his or her legs forwardly and then retracting them thereby defining a pumping action generally recognized as a conventional manner for inducing movement in such a swing. There are, however, other types of swings each having a different style of movement. Examples of other styles of swings are disclosed by Guihan in U.S. Pat. No. 3,127,169; by Morrow in U.S. Pat. No. 3,186,711; by Bourne in U.S. Pat. No. 3,858,871; by Potyondy in U.S. Pat. No. 4,036,489; and by Lelong in U.S. Pat. No. 4,046,375.

SUMMARY OF INVENTION

The present invention provides a swing for use by an individual for exercise or amusement wherein the individual, while seated in the swing, supplies energy in a conventional fashion to move the swing at least forwardly and backwardly and to cause the swing, which is secured to a revolving supporting arm, to move in an increasing arcuate fashion and finally through an arc of 360° about a stationery central support. The stationery central support or post is attached at its proximal end to a horizontal point of reference, such as the ground or a floor, and has at its distal end a portion which is rotatable relative to the central support. Attached to the rotatable portion is at least one radially outwardly extending cross member or supporting arm which arm is positioned such that it describes a circle which defines a plane which plane is not parallel to the horizontal plane of reference. The swing further includes at least one seat each of which is suspended by at least one vertically disposed supporting member attached at a point located near the outer end of a respective cross member. When two or more supporting members are employed for each seat, the distal end of each of the supporting members is connected to the seat and the proximal end of each of the supporting members is operatively connected to one point on the outer end of the cross member such that the seat remains substantially perpendicular to each of the supporting members during operation of the swing.

One object of the invention is to provide a simple and efficient user-operated apparatus for supporting a rider and for allowing the rider simultaneously to swing substantially in a conventional fashion to move in an arcuate fashion about a fixed or stationary central support, such that the rider will have an exhilarating as well as an entertaining ride.

Another object of the invention is to provide a user operated revolving swing having a central support upon which is mounted a bearing device, which bearing device provides rotational support for a supporting arm or cross member which cross member has at its distal end a swing seat depending therefrom.

Another object of the invention is to provide a user operated playground device having a cross member which suspends a swing seat, which cross member rotatably translates in a manner which defines a plane arranged in nonparallel relationship with the horizontal plane of reference, for example the ground or a floor.

Another object of the invention is to provide a user operated amusement device in which the user utilizes his or her weight to engage in a conventional swinging motion and to further manipulate his or her weight to move the swing in an arcuate fashion about a central support in such a way that the swing is caused to move through a series of ever increasing arcs until the swing is caused to make at least one complete revolution about the central support.

Another object of the invention is to provide a swing seat suspended from a cross member which seat is capable of being moved upwardly and downwardly in an arcuate fashion and which seat is capable of being moved forwardly and backwardly in an arcuate as well as in a circular fashion about a stationery central support.

These and other objects of the present invention will become apparent from a consideration of the following taken in conjunction with the drawings forming a part of this application.

DETAILED DESCRIPTION OF THE INVENTION

Figure 1:
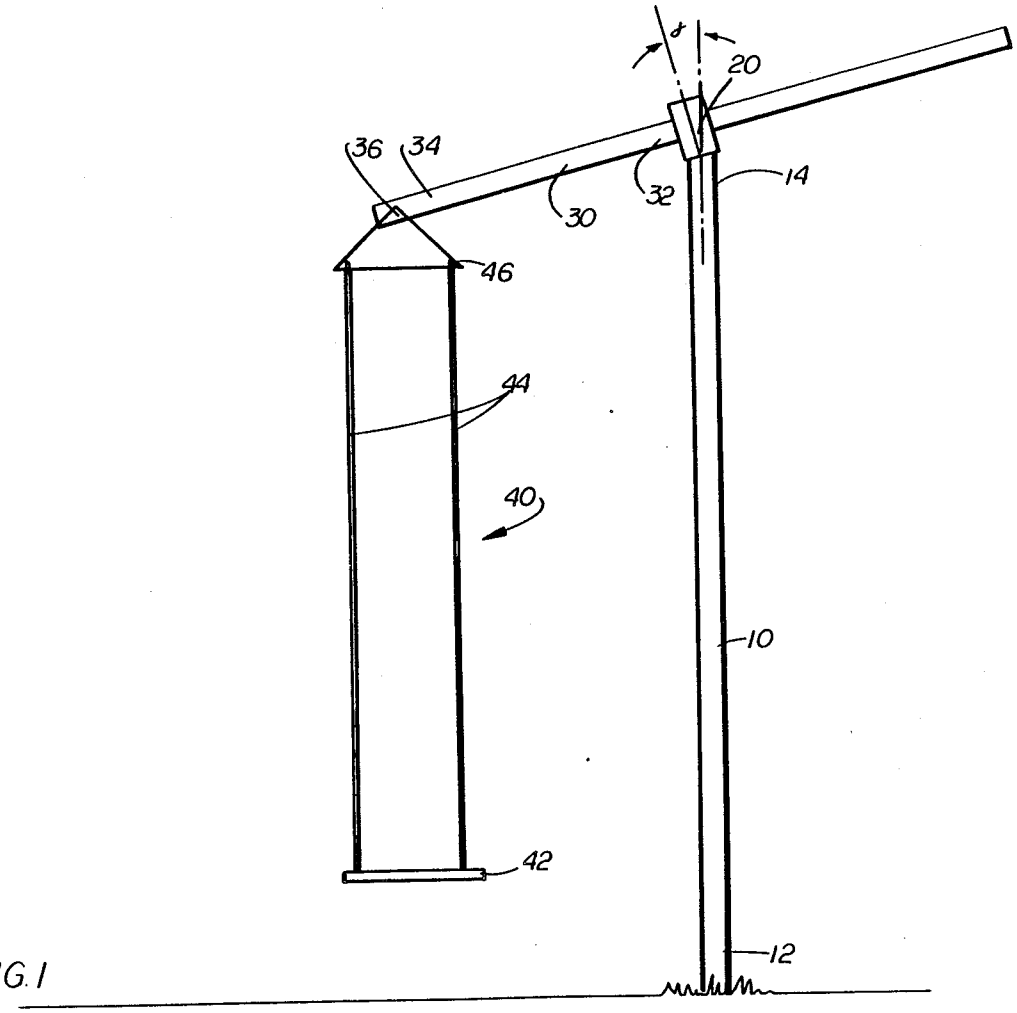
FIG. 1 is a side elevation view of the swing of the present invention with the rotational motion illustrated schematically by phantom line representation.

The amusement device of the present invention comprises a central support 10 having its proximal end 12 associated with a horizontal plane of reference such as the ground or a floor, and bearing at its distal end 14 a rotatable hub including a bearing device 20 comprising, for example, a ball bearing trunnion. Bearing device 20 rotatably supports a supporting arm or cross member 30 which cross member is attached at its proximal end 32 to the bearing device. Cross member 30 extends radially outwardly from the bearing device 20 and supports a swing 40. Swing 40 comprises a seat 42 suspended from the distal end 34 of cross member 30 by at least one and preferably by two supporting members 44 which supporting members 44 preferably are flexible. Two examples of acceptable flexible supporting members include chain and rope. The seat may include several styles not limited to a traditional flat, rigid, substantially rectangular seat, to a flexible seat, or to a chair style seat.

Figure 2A:
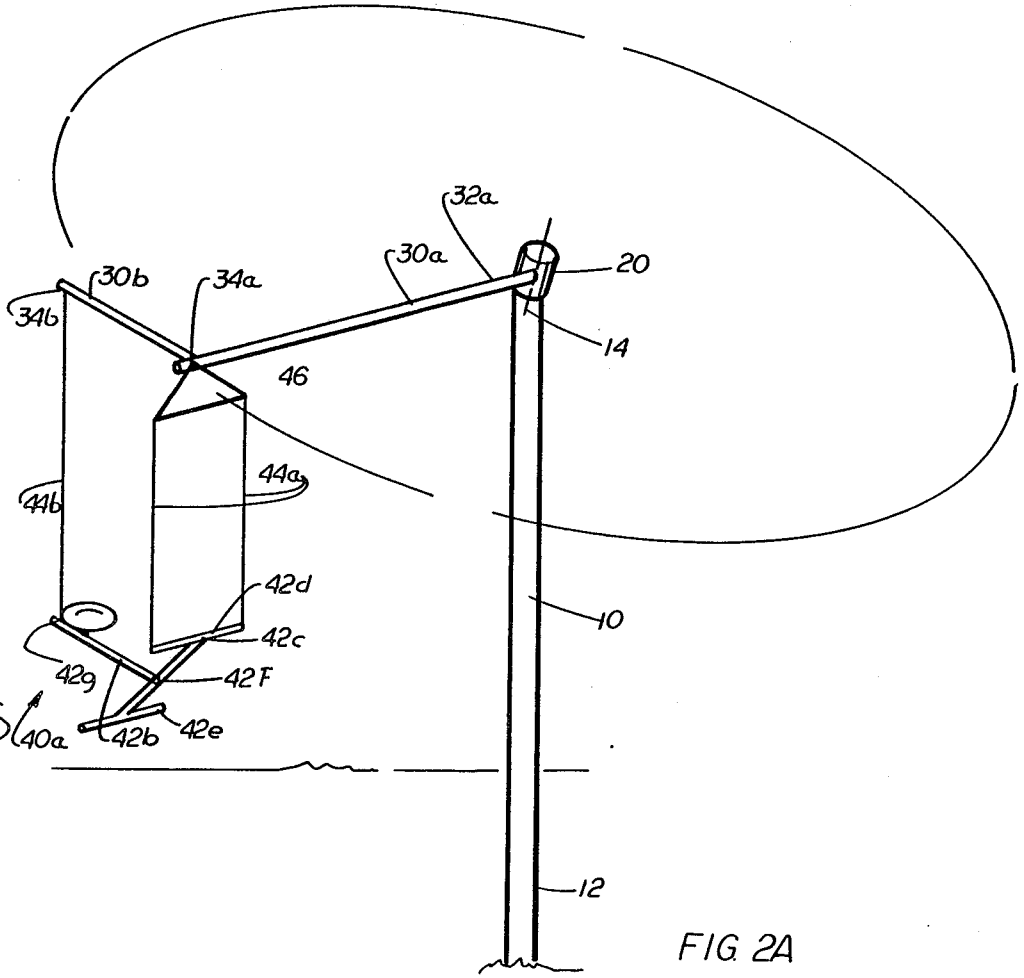
FIG. 2A is a perspective view of an alternative embodiment of the swing having a saddle style seat.
Figure 2B:
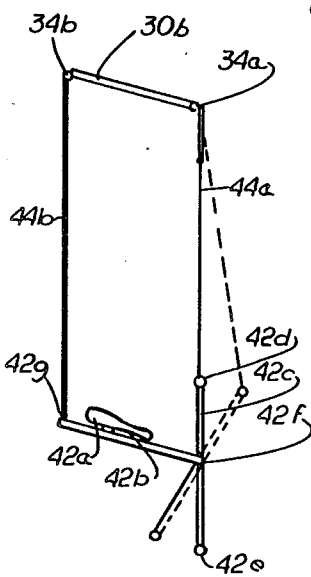
FIG. 2B is a side view of the seat of FIG. 2A showing pivotal handle and stirrup portions.

In an alternative embodiment, the seat, as shown in FIGS. 2A and 2B, comprises an alternative cross member **30*a* connected at its proximal end 32*a* to bearing 20, and having a perpendicularly positioned end member 30*b* located at the distal end 34*a* of alternative cross member 30*a*. The seat 40*a* comprises a saddle 42*a* borne on horizontal support member 42*b*, an elevated handle 42*d* and a lower foot rest 42*e* attached at opposite ends of a bar 42*c* which bar is pivotally attached to a forward end of horizontal support member 42*b* at point 42*f*. Distal end portions of flexible members 44*a* are attached to respective portions of elevated handles 42*d*, and proximal end portions of flexible members 44*a* are operatively connected to the distal end 34*a* of cross member 30*a*. An opposite end of horizontal support member 42*b* is supported at point 42*g* by flexible support member 44*b* (like flexible support members 44*a*) connected to end member 30*b* at point 34*b*. Flexible members 44*a* are identical to flexible members 44 and may be positioned in parallel one with the other by a rigid spreader 46**.

In the preferred embodiment, the swing seat 42 is planar, rigid, and substantially rectangular in form and is suspended at its outer edges and in opposed fashion by two vertically disposed, flexible supporting members 44. Each of the supporting members is attached at its distal end at a point near or at the periphery of swing seat 42, and is operatively connected at its proximal end to the distal end 34 of cross member 30. The proximal end of each flexible supporting member may be operatively connected to cross member 30 in several ways including gathering and connecting each proximal end portion to cross member 30 at point 36; utilizing a plurality of additional supporting members with each additional supporting member being connected to a respective one of said proximal end portions, which additional supporting members are gathered and connected to cross member 30 at point 36; and utilizing a yoke connected to each proximal end portion which yoke is connected to cross member 30 at point 36.

Figure 3:
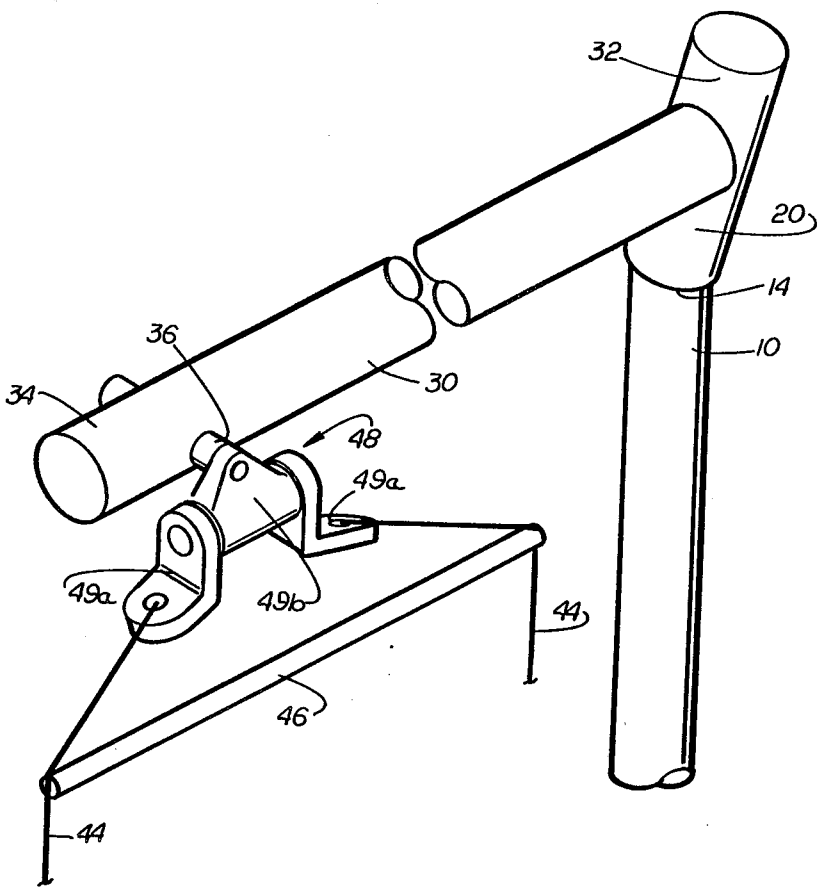
FIG. 3 is a perspective view of a yoke device for attaching the flexible support members to the cross member.

In the preferred embodiment, the flexible members 44 are arranged substantially in parallel fashion. For example, one arrangement provides for the proximal ends of the flexible supporting members to be gathered at point 36 of the distal end 34 of cross member 30, but with a rigid brace or spreader 46 positioned substantially horizontally along the length of each vertically disposed flexible member 44 such that the portion of at least one of the flexible members occurring between the rigid spreader 46 and the seat 42 is parallel to a like portion of at least one of the remaining flexible members 44. In one embodiment, the yoke, as shown in FIG. 3, is pivotally attached at a right angle to the cross member 30 at the distal end portion 34 by a bracket 48 having a hinge axis positioned below and perpendicular to the pivot axis positioned at a right angle to cross member 30. Attachment members **49*a* secure the proximal end of each respective supporting member, and are pivotally attached to a substantially triangular supporting member 49*b*. In a similar example, spreader 46 may comprise a portion of the aforementioned yoke, for example, spreader 46 may be fixedly secured to attachment members 49*a*. In any event, by utilizing a single connecting point 36, such arrangement allows the seat 42 to be suspended by a plurality of flexible members 44 and allows the seat 42 to remain substantially perpendicular to each of the flexible members 44** as the seat moves omnidirectionally.

In the preferred embodiment, central support 10 is positioned such that its longitudinal axis is perpendicular to a horizontal plane of reference, such as the ground or a floor. Bearing device 20 located at the distal end 14 of central support 10 is canted or offset such that the longitudinal axis of the bearing device 20 intersects the longitudinal axis of the central support 10 to form, for example, an acute angle greater than zero degrees but not greater than forty-five degrees. Since the housing associated with bearing device 20 is fixedly secured to central support 10, this angle remains constant. Consequently, cross member 30 rotates about the longitudinal axis of the bearing device 20 and, as cross member 30 moves, it describes a circle which defines a plane which plane is not parallel to the horizontal plane of reference, but which plane intersects the horizontal plane of reference at substantially the same acute angle which is defined by the intersection of the longitudinal axis of bearing device 20 and the longitudinal axis of central support 10. Thus, this plane is positioned at an oblique angle both to the horizontal plane of reference and to a vertical line of reference. Accordingly, as the supporting arm 30 rotates about the longitudinal axis of the bearing device 20, the vertical distance as measured perpendicularly from the distal end 34 of the supporting arm 30 to the horizontal plane of reference, varies due to the constant angle at which the bearing device 20 is positioned with respect to the horizontal plane of reference.

In a second embodiment, central support 10 is positioned such that its longitudinal axis forms an acute angle with a vertical reference line which line is perpendicular to a horizontal plane of reference, such as the ground or a floor. Bearing device 20 is located at the distal end 14 of central support 10 with a longitudinal axis of the bearing device 20 and the longitudinal axis of central support 10 being coaxially aligned. Like the earlier described preferred embodiment, as cross member 30 rotates about the longitudinal axis of the bearing device 20, it describes a circle which defines a plane which plane is not parallel to the horizontal plane of reference, but which intersects the horizontal plane of reference at substantially the same acute angle which angle is defined by the intersection of the longitudinal axis of the central support 10 or by the longitudinal axis of bearing device 20, with the aforementioned vertical line of reference. The plane is positioned at an oblique angle both to the horizontal plane of reference and to the vertical line of reference, but is substantially perpendicular to the aforementioned coaxially aligned longitudinal axes. Likewise, as the supporting arm 30 rotates about the longitudinal axis of the bearing device 20, the vertical distance as measured perpendicularly from the distal end 34 of the supporting arm 30 to the horizontal plane of reference, varies due to the constant angle at which the bearing device is positioned with respect to the horizontal plane of reference.

Figure 4A:
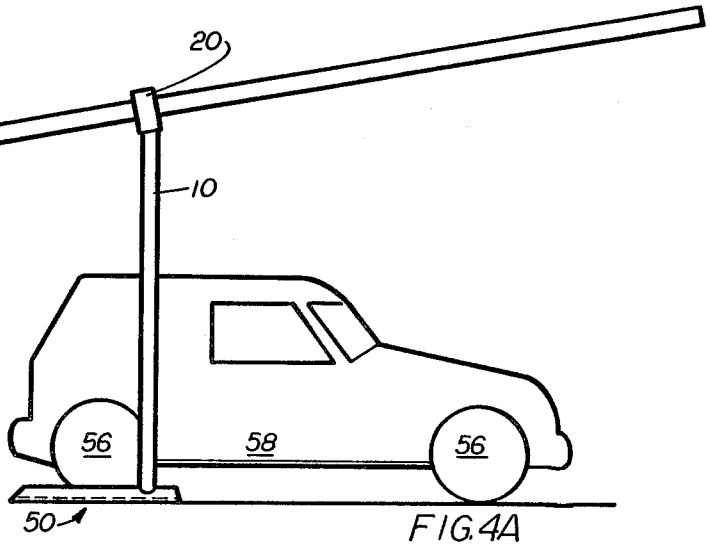
FIG. 4A is a side elevational view of a gravity stabilized portable mast having a base portion stabilized through placement of a vehicle thereon.
Figure 4B:
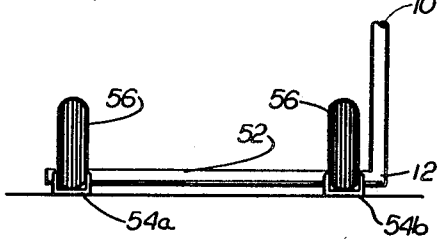
FIG. 4B is a partial end view of the base of FIG. 4A showing placement of the vehicle's tires on the base.
Figure 4C:
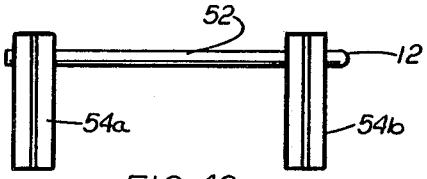
FIG. 4C is a bottom view of the base associated with the mast of FIGS. 4A and 4B.

In both of the aforementioned embodiments, the distal end 12 of the central support 10 may be associated in several ways with the horizontal plane of reference, the ground or floor. For example, the central support may be embedded in the ground to a depth that ensures that the central support 10 is fixedly secured in position. Alternatively, central support 10 may be associated with a transportable flat base which base is large enough so that the swing of the present invention will not tip over during operation. An example of one type of base is a relatively large flat structure positioned against and parallel to a floor or to the ground. Fastening means such as bolts may be used to further secure the base to the floor or to an anchor a portion of which is positioned in the ground. In addition, central support 10 may be supported by braces selectively arranged about the end portion of the central support 10 closest to the ground or floor. Finally, another example of a gravity stabilized portable mast and base is shown in FIGS. 4A, 4B and 4C. Base 50 comprises a rod-like support member 52 attached to the proximal end 12 of central support 10. Secured to member 52 are two channel members **54*a* and 54*b* each preferably having a U-shaped transverse cross-section. Channel members 54*a* and 54*b* are positioned along support member 52 such that the channel portion of each member can accommodate either a set of front or a set of rear wheel and tire combinations 56 of a vehicle 58**. The rod-like support member and two channel members are designed for easy, space-saving storage and for portability.

Also, in both of the aforementioned embodiments, the proximal end 32 of the cross member 30 may be extended radially outwardly in a direction opposite to that of distal end 34 of cross member 30 and have mounted on this opposite distal end portion a counter balancing means of selected weight. This weight serves to offset the weight of the rider and to facilitate rotation of the swing about the central support. In the alternative, the opposite distal end portion may support a swing.

In operation of the preferred embodiment, a rider sits in seat 42 and grasps flexible supporting members 44. The rider repeatedly thrusts his legs forwardly and then retracts them in a conventional "pumping" style thereby causing the swing seat to move forwardly and backwardly. As the rider continues to surge his body, the swing 40 gains momentum and amplitude, and cross bar 30 moves through a series of increasing arcs about the longitudinal axis of bearing device 20. Finally, cross member 30 gains enough momentum to travel in a complete circular arc. As a consequence, the rider orbits central support 10.

In operation of the alternative embodiment, as shown in FIG. 2B, a rider sits in saddle **42*a* straddled horizontal support member 42*b* with feet positioned on foot rest 42*e* and with hands grasping handle 42*d*. The rider then moves the handle 42*d* and foot rest 42*c* back and forth by pivoting movement about pivot point 42*f*, to impart a "pumping" action thus causing the seat 40*a* to move forwardly and backwardly. As the rider continues to move his body, the swing 40*a* gains momentum an amplitude, and crossbar 30*a* moves through a series of increasing arcs about the longitudinal axis of swing devise 20. Finally, cross member 30*a* gains enough momentum to travel in a complete circular arc. As a consequence, the rider orbits central support 10**.

Thus, with either seat type, the swing, due to its specific method of attachment to the cross member, allows the rider to move outwardly because of the centrifugal force generated by the rider as the swing rotates about the central support 10. This orbital movement when associated with the rotational movement about central support 10, provides a thrilling ride having certain recreational and entertainment value.

I claim:

1. A rider propelled recreational device comprising:

a central support associated at its proximal end with a horizontal plane of reference and having mounted at its distal end a bearing device, said central support having its longitudinal axis positioned perpendicularly to said horizontal plane of reference, and said bearing device being fixedly attached to said distal end of said central support with the longitudinal axis of said bearing device inclined relative to said horizontal plane of reference and intersecting the longitudinal axis of said central support to define an acute angle therebetween;

at least one radially outwardly extending cross member mounted at its proximal end to said bearing device for rotation about the longitudinal axis of said bearing device, said cross member being rotatable about said longitudinal axis of said bearing device to describe a circle defining a second plane which second plane is positioned in non-parallel relationship with said horizontal plane of reference; and a swing suspended for omnidirectional and translational movement, from the distal end of said cross member, said swing comprising at least two flexible supporting members operatively connected at their respective proximal ends to a single point located on the distal end portion of said cross member and at their respective distal ends to a seat suspended by said supporting members, at least a portion of said supporting members being arranged substantially parallel one with another with a spreader of selected length placed intermediately of said seat and said cross member to position in said substantially parallel fashion said portion of each of said supporting members occurring between said seat and said spreader.

2. A recreational device comprising:

a central support associated at its proximal end with a horizontal plane of reference and having a bearing device mounted at its distal end;

at least one radially outwardly extending cross member mounted at its proximal end to said bearing device for rotation about the longitudinal axis of said bearing device;

a swing suspended from the distal end of said cross member, said bearing device being positioned with its longitudinal axis at an oblique angle relative to said horizontal plane of reference and said cross member being rotatably movable about said longitudinal axis of said bearing device to describe a circle which circle defines a second plane which second plane is positioned in nonparallel relationship with said horizontal plane of reference, and a portable base attached to the proximal end of said central support, said base including a rod-like member attached to said proximal end of said central support and bearing two channel members each of said channel members being of U-shaped transverse cross-section and each of said channel members positioned to accommodate at least one tire borne by a vehicle.

3. The recreational device of claim 2 further comprising at least two of said radially outwardly extending cross members mounted at their respective proximal ends to said bearing device, each of said cross members radiating outwardly from said bearing device and positioned equidistantly about said bearing device, and each of said cross members suspending one of said swings.

4. The recreational device of claim 2 wherein said swing comprises a seat suspended from said distal end of said cross members by at least one supporting member.

5. Said recreational device of claim 4 wherein said supporting member is a flexible supporting member.

6. A recreational device comprising:

a central support associated at its proximal end with a horizontal plane of reference and having a bearing device mounted at its distal end;

at least one radially outwardly extending cross member mounted at its proximal end to said bearing device for rotation about the longitudinal axis of said bearing device; and a swing suspended from the distal end of said cross member, said bearing device being positioned with its longitudinal axis at an oblique angle relative to said horizontal plane of reference and said cross member being rotatably movable about said longitudinal axis of said bearing device to describe a circle which circle defines a second plane which second plane is positioned in nonparallel relationship with said horizontal plane of reference, said longitudinal axis of central support being inclined with respect to said horizontal plane of reference, and said longitudinal axis of said central support and said longitudinal axis of said bearing device being coaxially aligned one with the other and defining an angle with respect to said horizontal plane of reference.

7. A recreational device comprising:

a central support associated at its proximal end with a horizontal plane of reference and having a bearing device mounted at its distal end;

at least one radially outwardly extending cross member mounted at its proximal end to said bearing device for rotation about the longitudinal axis of said bearing device;

a swing suspended from the distal end of said cross member, said bearing device being positioned with its longitudinal axis at an oblique angle relative to said horizontal plane of reference and said cross member being rotatably movable about said longitudinal axis of said bearing device to describe a circle which circle defines a second plane which second plane is positioned in nonparallel relationship with said horizontal plane of reference, said swing including at least two flexible supporting members operatively connected at their respective proximal ends to a single point on said distal end portion of said cross member, and at their respective distal ends to a seat suspended thereby; and a yoke pivotally attached to said cross member by a bracket having a first hinge axis perpendicular to the longitudinal axis of said cross member, a first attachment member hingedly joined to a first side of said bracket along a second hinge axis positioned below and perpendicular to said first hinge axis, a second attachment member hingedly joined to a second side of said bracket along said second hinge axis, at least one aperture borne on said first attachment member for receiving said proximal end of one of said flexible supporting members, and at least one aperture borne on said second attachment member for receiving said proximal end of another of said flexible supporting members.

8. The recreational device of claim 7 wherein said seat further comprises a saddle borne on a horizontal support member, an elevated handle and a foot rest attached at opposite ends of a bar pivotally attached to a forward end of said horizontal support member, and at least three flexible supporting members of which two of said flexible supporting members are operatively connected at their respective proximal ends to a single point on said distal end portion of said cross member and at their respective distal ends to said handle, and of which a third of said three flexible supporting members is connected at its proximal end to an outwardly projecting end portion of a bar attached to said cross member at said distal end of said cross member, and said third member is connected at its distal end at a point on said horizontal support member positioned rearwardly of said saddle.

9. The recreational device of claim 8 wherein said supporting members are arranged substantially parallel one to the other with a spreader of selected length placed intermediately of said seat and of said cross member to position in said substantially parallel fashion that portion of each supporting member occurring between said seat and said spreader.

10. The recreational device of claim 7 wherein said longitudinal axis of said central support is positioned perpendicularly to said horizontal plane of reference and said bearing device is fixedly attached to said distal end of said central support with the longitudinal axis of said bearing device intersecting the longitudinal axis of said central support to define an acute angle therebetween.

11. The recreational device of claim 7 wherein said longitudinal axis of central support is inclined with respect to said horizontal plane of reference, and said longitudinal axis of said central support and said longitudinal axis of said bearing device are coaxially aligned one with the other and define an angle with respect to said horizontal plane of reference.

12. A rider propelled recreational device comprising:

a central support associated at its proximal end with a horizontal plane of reference and having mounted at its distal end a bearing device, said central support having its longitudinal axis positioned perpendicularly to said horizontal plane of reference, and said bearing device being fixedly attached to said distal end of said central support with the longitudinal axis of said bearing device inclined relative to said horizontal plane of reference and intersecting the longitudinal axis of said central support to define an acute angle therebetween;

at least one radially outwardly extending cross member mounted at its proximal end to said bearing device for rotation about the longitudinal axis of said bearing device, said cross member being rotatable about said longitudinal axis of said bearing device to describe a circle defining a second plane which second plane is positioned in non-parallel relationship with said horizontal plane of reference;

a swing suspended for omnidirectional and translational movement, from the distal end of said cross member, said swing comprising at least two flexible supporting members operatively connected at their respective proximal ends to a single point located on the distal end portion of said cross member and at their respective distal ends to a seat suspended by said supporting members, at least a portion of said supporting members being arranged substantially parallel one with another with a spreader of selected length placed intermediately of said seat and said cross member to position in said substantially parallel fashion said portion of each of said supporting members occurring between said seat and said spreader; and a portable base attached to the proximal end of said central support, said base including a rod-like member attached to said proximal end of said central support and bearing two channel members each of said channel members being of U-shaped transverse cross-section and each of said channel members being positioned to accommodate at least one tire borne by a vehicle.

13. The recreational device of claim 12 further comprising at least two of said radially outwardly extending cross members mounted at their respective proximal ends to said bearing device, each of said cross members radiating outwardly from said bearing device and positioned equidistantly about said bearing device, and each of said cross members suspending one of said swings.

14. A rider propelled recreational device comprising:

a central support associated at its proximal end with a horizontal plane of reference and having mounted at its distal end a bearing device, said central support having its longitudinal axis positioned perpendicularly to said horizontal plane of reference, and said bearing device being fixedly attached to said distal end of said central support with the longitudinal axis of said bearing device inclined relative to said horizontal plane of reference and intersecting the longitudinal axis of said central support to define an acute angle therebetween;

at least one radially outwardly extending cross member mounted at its proximal end to said bearing device for rotation about the longitudinal axis of said bearing device, said cross member being rotatable about said longitudinal axis of said bearing device to describe a circle defining a second plane which second plane is positioned in non-parallel relationship with said horizontal plane of reference; and a swing suspended for omnidirectional and translational movement, from the distal end of said cross member, said swing comprising at least two flexible supporting members operatively connected at their respective proximal ends to a single point located on the distal end portion of said cross member and at their respective distal ends to a seat suspended by said supporting members, at least a portion of said supporting members being arranged substantially parallel one with another with a spreader of selected length placed intermediately of said seat and said cross member to position in said substantially parallel fashion said portion of each of said supporting members occurring between said seat and said spreader, said seat further comprising a saddle borne on a horizontal support member, an elevated handle and a foot rest attached at opposite ends of a bar pivotally attached to a forward end of said horizontal support member, and at least three flexible supporting members of which two of said flexible supporting members are operatively connected at their respective proximal ends to a single point on said distal end portion of said cross member and at their respective distal ends to said handle, and of which a third of said three flexible supporting members is connected at its proximal end to an outwardly projecting end portion of a bar attached to said cross member at said distal end of said cross member, and said third member is connected at its distal end at a point on said horizontal support member positioned rearwardly of said saddle.

15. The recreational device of claim 14 further comprising a yoke pivotally attached to said cross member by a bracket having a first hinge axis perpendicular to the longitudinal axis of said cross member, a first attachment member hingedly joined to a first side of said bracket along a second hinge axis positioned below and perpendicular to said first hinge axis, a second attachment member hingedly joined to a second side of said bracket along said second hinge axis, at least one aperture borne on said first attachment member for receiving said proximal end of one of said flexible supporting members, and at least one aperture borne on said second attachment member for receiving said proximal end of another of said flexible supporting members.

16. The recreational device of claim 15 further comprising at least two of said radially outwardly extending cross members mounted at their respective proximal ends to said bearing device, each of said cross members radiating outwardly from said bearing device and positioned equidistantly about said bearing device, and each of said cross members suspending one of said swings.

17. A rider propelled recreational device comprising:

a central support associated at its proximal end with a horizontal plane of reference and having mounted at its distal end a bearing device, said central support having its longitudinal axis inclined with respect to said horizontal plane of reference, and said bearing device being fixedly attached to said distal end of said central support with the longitudinal axis of said bearing device coaxially aligned with said longitudinal axis of said central support;

at least one radially outwardly extending cross member mounted at its proximal end to said bearing device for rotation about the longitudinal axis of said bearing device, said cross member being rotatable about said longitudinal axis of said bearing device to describe a circle defining a second plane which second plane is positioned in non-parallel relationship with said horizontal plane of reference; and a swing suspended for omnidirectional and for translational movement, from the distal end of said cross member, said swing comprising at least two flexible supporting members operatively connected at their respective proximal ends to a single point located on the distal end portion of said cross member and at their respective distal ends to a seat suspended by said supporting members, at least a portion of said supporting members being arranged substantially parallel one with another with a spreader of selected length placed intermediately of said seat and said cross member to position in said substantially parallel fashion said portion of each of said supporting members occurring between said seat and said spreader.

18. The recreational device of claim 17 further comprising a portable base attached to the proximal end of said central support, said base including a rod-like member attached to said proximal end of said central support and bearing two channel members each of said channel members being of U-shaped transverse cross-section and each of said channel members being positioned to accommodate one tire borne by a vehicle.

19. The recreational device of claim 17 further comprising at least two of said radially outwardly extending cross members mounted at their respective proximal ends to said bearinq device, each of said cross members radiating outwardly from said bearing device and positioned equidistantly about said bearing device, and each of said cross members suspending one of said swings.

20. The recreational device of claim 17 wherein said seat further comprises a saddle borne on a horizontal support member, an elevated handle and a foot rest attached at opposite ends of a bar pivotally attached to a forward end of said horizontal support member, and at least three flexible supporting members of which two of said flexible supporting members are operatively connected at their respective proximal ends to a single point on said distal end portion of said cross member and at their respective distal ends to said handle, and of which a third of said three flexible supporting members is connected at its proximal end to an outwardly projecting end portion of a bar attached to said cross member at said distal end of said cross member, and said third member is connected at its distal end at a point on said horizontal support member positioned rearwardly of said saddle.

21. The recreational device of claim 20 further comprising a yoke pivotally attached to said cross member by a bracket having a first hinge axis perpendicular to the longitudinal axis of said cross member, a first attachment member hingedly joined to a first side of said bracket along a second hinge axis positioned below and perpendicular to said first hinge axis, a second attachment member hingedly joined to a second side of said bracket along said second hinge axis, at least one aperture borne on said first attachment member for receiving said proximal end of one of said flexible supporting members, and at least one aperture borne on said second attachment member for receiving said proximal end of another of said flexible supporting members.

22. The recreational device of claim 21 further comprising at least two of said radially outwardly extending cross members mounted at their respective proximal ends to said bearing device, each of said cross members radiating outwardly from said bearing device and positioned equidistantly about said bearing device, and each of said cross members suspending one of said swings.

23. A rider propelled recreational device comprising:

a central support associated at its proximal end with a horizontal plane of reference and having a bearing device mounted at its distal end;

at least one radially outwardly extending cross member mounted at its proximal end to said bearing device for rotation about the longitudinal axis of said bearing device; and a swing suspended from the distal end of said cross member and used solely to propel said device, said swing including a seat, said bearing device being positioned with its longitudinal axis at an oblique angle relative to said horizontal plane of reference and said cross member being rotatably movable about said longitudinal axis of said bearing device to describe a circle which circle defines a second plane which second plane is positioned in nonparallel relationship with said horizontal plane of reference.

24. The recreational device of claim 23 wherein said swing comprises at least two flexible supporting members operatively connected at their respective proximal ends to a single point on said distal end portion of said cross member, and at their respective distal ends to said seat which is suspended thereby.

25. The recreational device of claim 23 wherein said longitudinal axis of said central support is positioned perpendicularly to said horizontal plane of reference and said bearing device is fixedly attached to said distal end of said central support with the longitudinal axis of said bearing device intersecting the longitudinal axis of said central support to define an acute angle therebetween.

26. The recreational device of claim 23 wherein said longitudinal axis of central support is inclined with respect to said horizontal plane of reference, and said longitudinal axis of said central support and said longitudinal axis of said bearing device are coaxially aligned one with the other and define an angle with respect to said horizontal plane of reference.

* * * * *